US006079223A

United States Patent [19]

Srinivasan et al.

[11] Patent Number: 6,079,223

[45] Date of Patent: Jun. 27, 2000

[54] CRYOGENIC AIR SEPARATION SYSTEM FOR PRODUCING MODERATE PURITY OXYGEN AND MODERATE PURITY NITROGEN

[75] Inventors: Vijayaraghavan Srinivasan, Williamsville; Minish Mahendra Shah, East Amherst; Andrew Chun-Pong Lau, Williamsville; Michael James Lockett, Grand Island, all of N.Y.

[73] Assignee: Praxair Technology, Inc., Danbury, Conn.

[21] Appl. No.: 09/304,102

[22] Filed: May 4, 1999

[51] Int. Cl.[7] ..... F25J 3/04

[52] U.S. Cl. ..... 62/643; 62/650

[58] Field of Search ..... 62/643, 650, 654

[56] References Cited

U.S. PATENT DOCUMENTS

| | | | |
|---|---|---|---|
| 2,861,432 | 11/1958 | Haselden | 62/29 |
| 4,308,043 | 12/1981 | Yearout | 62/13 |
| 5,144,809 | 9/1992 | Chevalier et al. | 62/36 |
| 5,410,885 | 5/1995 | Smolarek et al. | 62/25 |
| 5,592,832 | 1/1997 | Herron et al. | 62/646 |
| 5,694,790 | 12/1997 | Lavin | 62/640 |

*Primary Examiner*—Henry Bennett
*Assistant Examiner*—Malik N. Drake
*Attorney, Agent, or Firm*—Stanley Ktorides

[57] ABSTRACT

A cryogenic air separation system wherein feed air is initially processed to produce a vapor and a liquid, the vapor is then processed in the rectifying section of a reflux condenser to produce moderate purity nitrogen, and the liquid is processed in the stripping section of the reflux condenser to produce moderate purity oxygen.

10 Claims, 4 Drawing Sheets

CRYOGENIC AIR SEPARATION SYSTEM FOR PRODUCING MODERATE PURITY OXYGEN AND MODERATE PURITY NITROGEN

TECHNICAL FIELD

This invention relates generally to the cryogenic rectification of air to produce oxygen and nitrogen products.

BACKGROUND ART

There are several industrial applications that require both moderate purity oxygen, such as for use in furnace operations or chemical oxidation processes, and moderate purity nitrogen, such as for use in inerting, drying or blanketing. Conventional cryogenic air separation systems, such as those employing cryogenic rectification columns to produce the products, have not proved to be economically attractive for the production of this product slate.

Accordingly, it is an object of this invention to provide a cryogenic air separation system which can economically produce both moderate purity oxygen and moderate purity nitrogen.

SUMMARY OF THE INVENTION

The above and other objects, which will become apparent to those skilled in the art upon a reading of this disclosure, are attained by the present invention, one aspect of which is:

A method for producing moderate purity oxygen and moderate purity nitrogen by cryogenic air separation comprising:

(A) partially condensing feed air, passing the partially condensed feed air into a column, and separating the feed air by cryogenic rectification within the column into nitrogen-enriched vapor and oxygen-enriched liquid;

(B) passing nitrogen-enriched vapor into the rectifying section of a reflux condenser having a rectifying section and a stripping section, and passing the nitrogen-enriched vapor up the rectifying section while partially condensing the upflowing nitrogen-enriched vapor to produce nitrogen-richer fluid and residual liquid;

(C) recovering nitrogen-richer fluid as product moderate purity nitrogen and passing residual liquid into the upper portion of the column;

(D) passing oxygen-enriched liquid from the lower portion of the column into and down the stripping section of the reflux condenser while partially vaporizing the downflowing oxygen-enriched liquid to produce oxygen-richer fluid and residual vapor; and (E) recovering oxygen-richer fluid as product moderate purity oxygen.

Another aspect of the invention is:

Apparatus for producing moderate purity oxygen and moderate purity nitrogen by cryogenic air separation comprising:

(A) a heat exchanger, a column, means for providing feed air to the heat exchanger, and means for providing feed air from the heat exchanger into the column;

(B) a reflux condenser having a rectifying section and a stripping section, and means for passing fluid from the upper portion of the column into the rectifying section;

(C) means for recovering fluid from the rectifying section as product moderate purity nitrogen, and means for passing fluid from the rectifying section into the upper portion of the column;

(D) means for passing fluid from the lower portion of the column into the stripping section; and (E) means for recovering fluid from the stripping section as product moderate purity oxygen.

A further aspect of the invention is:

A method for producing moderate purity oxygen and moderate purity nitrogen by cryogenic air separation comprising:

(A) partially condensing feed air to produce a vapor feed air portion and a liquid feed air portion, passing the vapor feed air portion into the rectifying section of a reflux condenser having a rectifying section and a stripping section, and passing the liquid feed air portion into the stripping section of the reflux condenser;

(B) passing the vapor feed air portion up the rectifying section while partially condensing the upflowing vapor feed air portion to produce nitrogen-richer fluid and residual liquid;

(C) recovering nitrogen-richer fluid as product moderate purity nitrogen and passing residual liquid into the stripping section;

(D) passing liquid feed air portion and residual liquid down the stripping section while partially vaporizing the downflowing liquid to produce oxygen-richer fluid and residual vapor; and (E) recovering oxygen-richer fluid as product moderate purity oxygen.

Yet another aspect of the invention is:

Apparatus for producing moderate purity oxygen and moderate purity nitrogen by cryogenic air separation comprising:

(A) a heat exchanger, a phase separator, means for providing feed air to the heat exchanger, and means for providing feed air from the heat exchanger to the phase separator;

(B) a reflux condenser having a rectifying section and a stripping section, means for passing fluid from the phase separator to the rectifying section, and means for passing fluid from the phase separator to the stripping section;

(C) means for recovering fluid from the rectifying section as product moderate purity nitrogen;

(D) means for passing fluid from the rectifying section of the reflux condenser to the stripping section of the reflux condenser; and (E) means for recovering fluid from the stripping section as product moderate purity oxygen.

As used herein the term "feed air" means a mixture comprising primarily oxygen and nitrogen, such as ambient air.

As used herein the term "moderate purity oxygen" means a fluid having an oxygen concentration within the range of from 25 to 80 mole percent.

As used herein the term "moderate purity nitrogen" means a fluid having a nitrogen concentration within the range from 95 to 99.9 mole percent.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

As used herein the term "indirect heat exchange" means the bringing of two fluids into heat exchange relation without any physical contact or intermixing of the fluids with each other.

As used herein the terms "turboexpansion" and "turboexpander" means respectively method and apparatus for the flow of high pressure gas through a turbine to reduce the pressure and the temperature of the gas thereby generating refrigeration.

As used herein the terms "upper portion" and "lower portion" mean those sections of a column respectively above and below the mid point of the column.

As used herein the terms "subcooling" and "subcooler" means respectively method and apparatus for cooling a liquid to be at a temperature lower than the saturation temperature of that liquid for the existing pressure.

As used herein the term "phase separator" means a vessel wherein incoming two phase feed is separated into individual vapor and liquid fractions. Typically, the vessel has sufficient cross-sectional area so that the vapor and liquid are separated by gravity.

As used herein the term "reflux condenser" means a heat exchanger device containing a plurality of vertically oriented finned passages for the flow of vapor from the bottom to the top of the passages, collectively termed the rectifying section of the reflux condenser, and a plurality of vertically oriented finned passages for the flow of liquid from the top to the bottom of the passages, collectively termed the stripping section of the reflux condenser. Each rectification tube or passage is in heat exchange relationship with at least one stripping tube or passage such that the vapor rising through the rectifying passages is partially condensed by indirect heat exchange with the liquid flowing down the stripping passages which is partially vaporized.

The numerals used in the Figures are the same for the common elements.

DETAILED DESCRIPTION

An important element of the invention is the prevention of direct mixing of liquids having different compositions prior to their passage into the stripping section of the reflux condenser, thereby avoiding a thermodynamic inefficiency and enabling the invention to produce the desired products in a more efficient manner.

Figure 1:
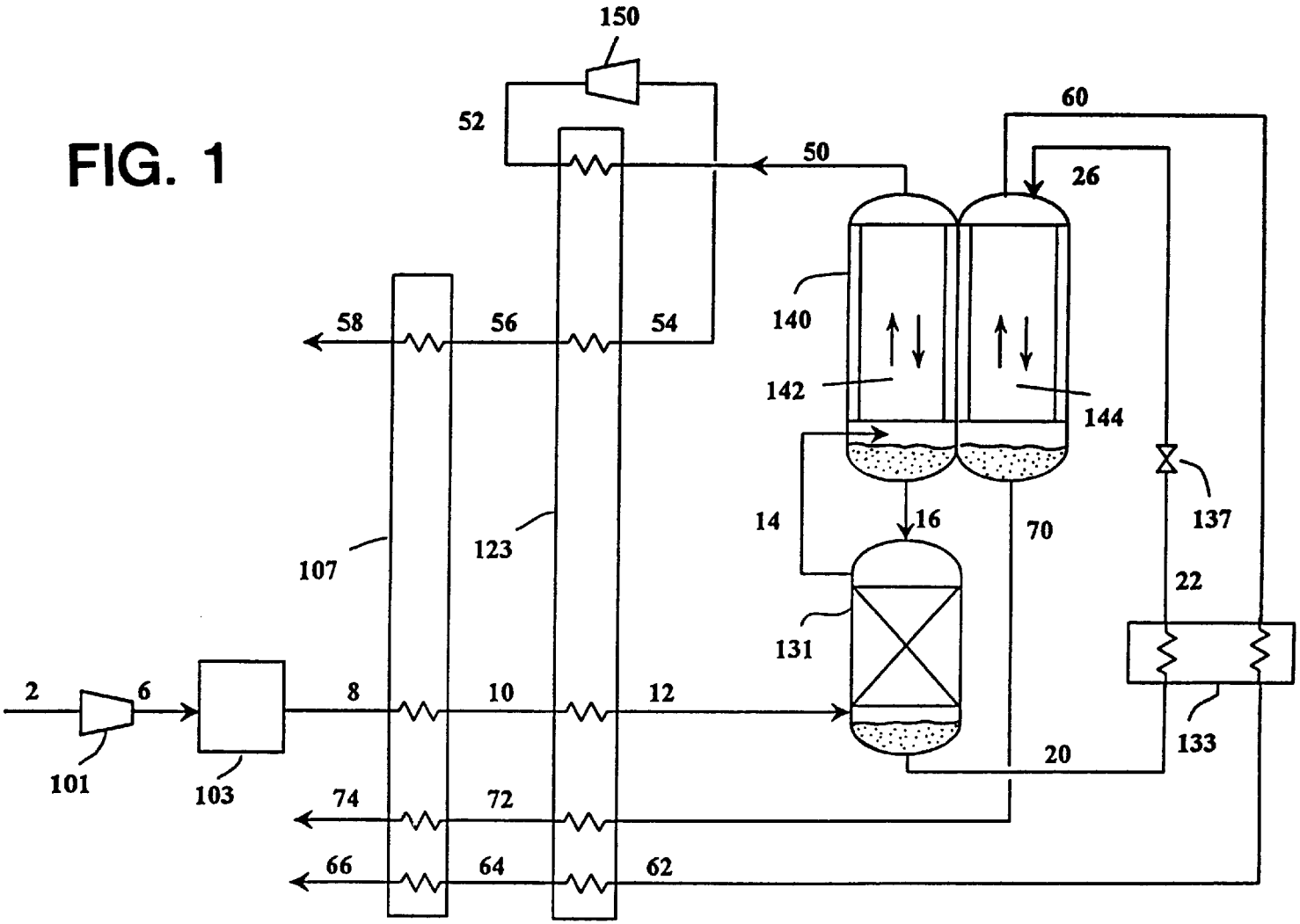
FIG. 1 is a schematic representation of one preferred embodiment of the invention wherein a column is employed in conjunction with a reflux condenser.

The invention will be described in greater detail with reference to the Drawings. Referring now to FIG. 1, feed air 2 is compressed to a pressure generally within the range of from 30 to 70 pounds per square inch absolute (psia) by passage through compressor 101 and resulting compressed feed air stream 6 is cleaned of high boiling impurities such as water vapor and carbon dioxide, by passage through purifier 103. Cleaned, cooled feed air stream 8 is cooled to near its dew point in heat exchanger 107 by indirect heat exchange with return streams, and resulting feed air stream 10 is partially condensed in heat exchanger 123 by indirect heat exchanger with return streams. Resulting two-phase feed air stream 12 is passed into column 131.

Column 131 is operated at a pressure generally within the range of from 28 to 68 psia. Within column 131 the feed air is separated by cryogenic rectification into nitrogen-enriched vapor and oxygen-enriched liquid. The nitrogen-enriched vapor is passed from the upper portion of column 131 in line 14 into the rectifying section of reflux condenser 140 which also has a stripping section, illustrated in FIG. 1 in representational fashion as rectifying section 142 and stripping section 144. The nitrogen-enriched vapor flows up rectifying section 142 while being partially condensed by indirect heat exchange with downflowing liquid in stripping section 144 to produce nitrogen-richer fluid and residual liquid. The nitrogen-richer fluid is withdrawn from rectifying section 142 in vapor stream 50 and warmed by passage through heat exchanger 123. Resulting nitrogen-richer vapor stream 52 is turboexpanded by passage through turboexpander 150 to generate refrigeration and resulting refrigeration bearing nitrogen-richer vapor 54 is warmed by passage through heat exchanger 123. Resulting nitrogen-richer vapor stream 56 is further warmed by passage through heat exchanger 107 and recovered in stream 58 as product moderate purity nitrogen.

Residual liquid is passed in stream 16 from rectifying section 142 into the upper portion of column 131 as reflux liquid. Oxygen-enriched liquid is withdrawn from the lower portion of column 131 and passed in stream 20 through subcooler 133 wherein it is subcooled by indirect heat exchange with residual vapor as will be further discussed below. Resulting subcooled oxygen-enriched liquid 22 is passed through valve 137 and as stream 26 into stripping section 144. The oxygen-enriched liquid passes down stripping section 144 while being partially vaporized, as was previously described, to produce oxygen-richer fluid and residual vapor. The residual vapor is withdrawn from stripping section 144 in stream 60 and warmed by passage through subcooler 133 to effect the aforedescribed subcooling of the oxygen-enriched liquid. Resulting warmed residual vapor 62 is warmed by passage through heat exchanger 123 and resulting stream 64 further warmed by passage through heat exchanger 107 and removed from the system in stream 66.

Oxygen-richer fluid is withdrawn from stripping section 144 in liquid stream 70 and vaporized by passage through heat exchanger 123 by indirect heat exchange with the incoming partially condensing feed air. Resulting oxygen-richer vapor in stream 72 is further warmed by passage through heat exchanger 107 and recovered in stream 74 as product moderate purity oxygen.

Figure 2:
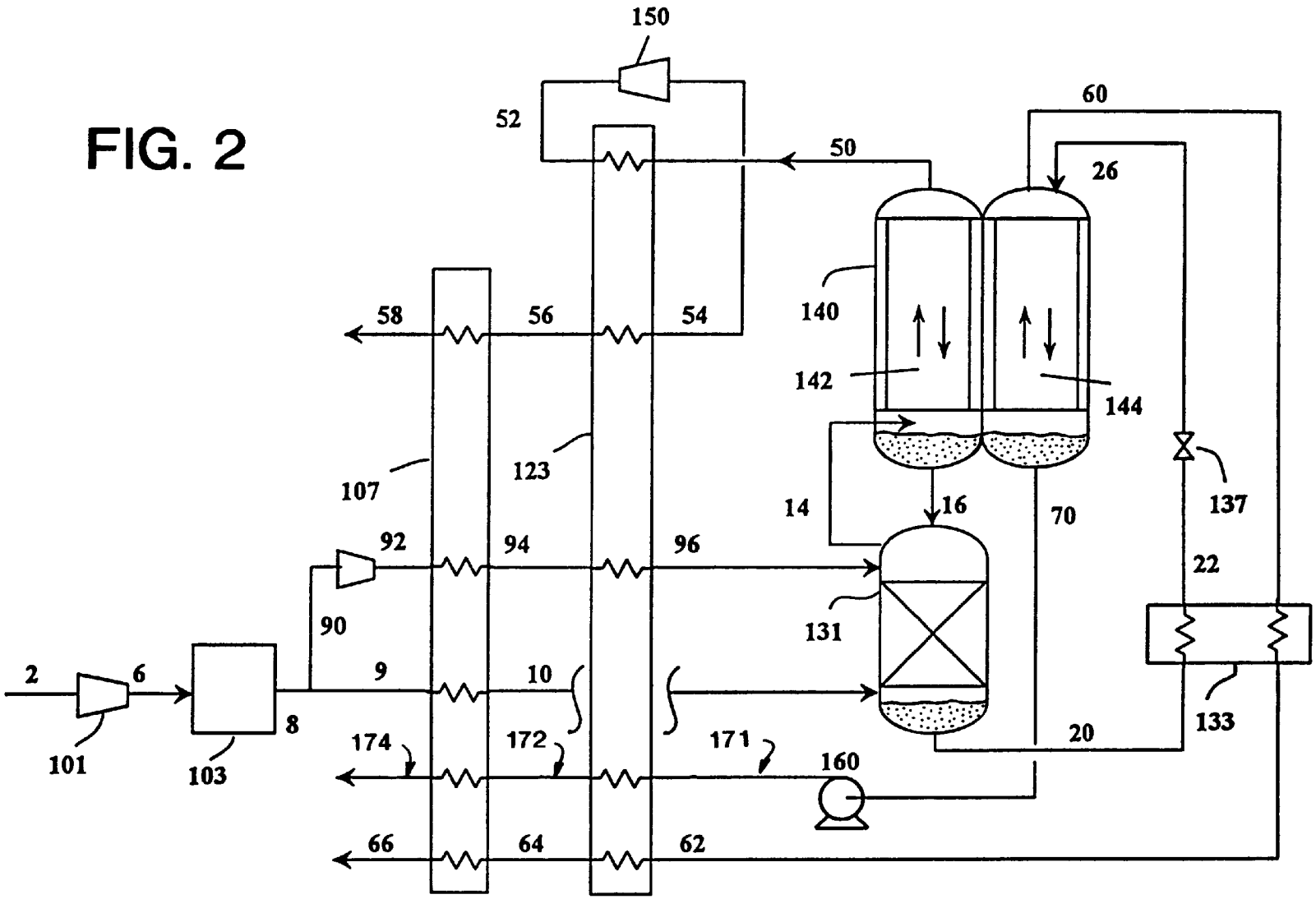
FIG. 2 is a schematic representation of another preferred embodiment of the invention wherein a column is employed in conjunction with a reflux condenser.

FIG. 2 illustrates an embodiment of the invention similar to that of FIG. 1 but where the product moderate purity oxygen is recovered at an elevated pressure. The aspects of the embodiment illustrated in FIG. 2 which are the same as those of the embodiment illustrated in FIG. 1 will not be further discussed in detail.

Referring now to FIG. 2, cleaned, cooled feed air 8 is divided into first feed air portion 9 and second feed air portion 90. First feed air portion 9 is cooled to near its dew point in heat exchanger 107 and passed in stream 10 into column 131. Second feed air portion 90 is compressed to a pressure generally within the range of from 50 to 250 psia by passage through compressor 92 and cooled to near its dew point by passage through heat exchanger 107. Resulting second feed air portion 94 is condensed in heat exchanger 123 by indirect heat exchange with vaporizing elevated pressure oxygen-richer fluid and resulting liquid second feed air portion 96 is passed into the upper portion of column 131. Oxygen-richer liquid in stream 70 is pumped to a pressure generally within the range of from 25 to 125 psia by passage through liquid pump 160. Resulting elevated pressure oxygen-richer liquid 171 is vaporized by indirect heat exchange with the condensing second feed air portion, as was previously described, and resulting elevated pressure oxygen-richer vapor 172 is further warmed by passage through heat exchanger 107 and then recovered in stream 174 as elevated pressure moderate purity oxygen product.

Figure 3:
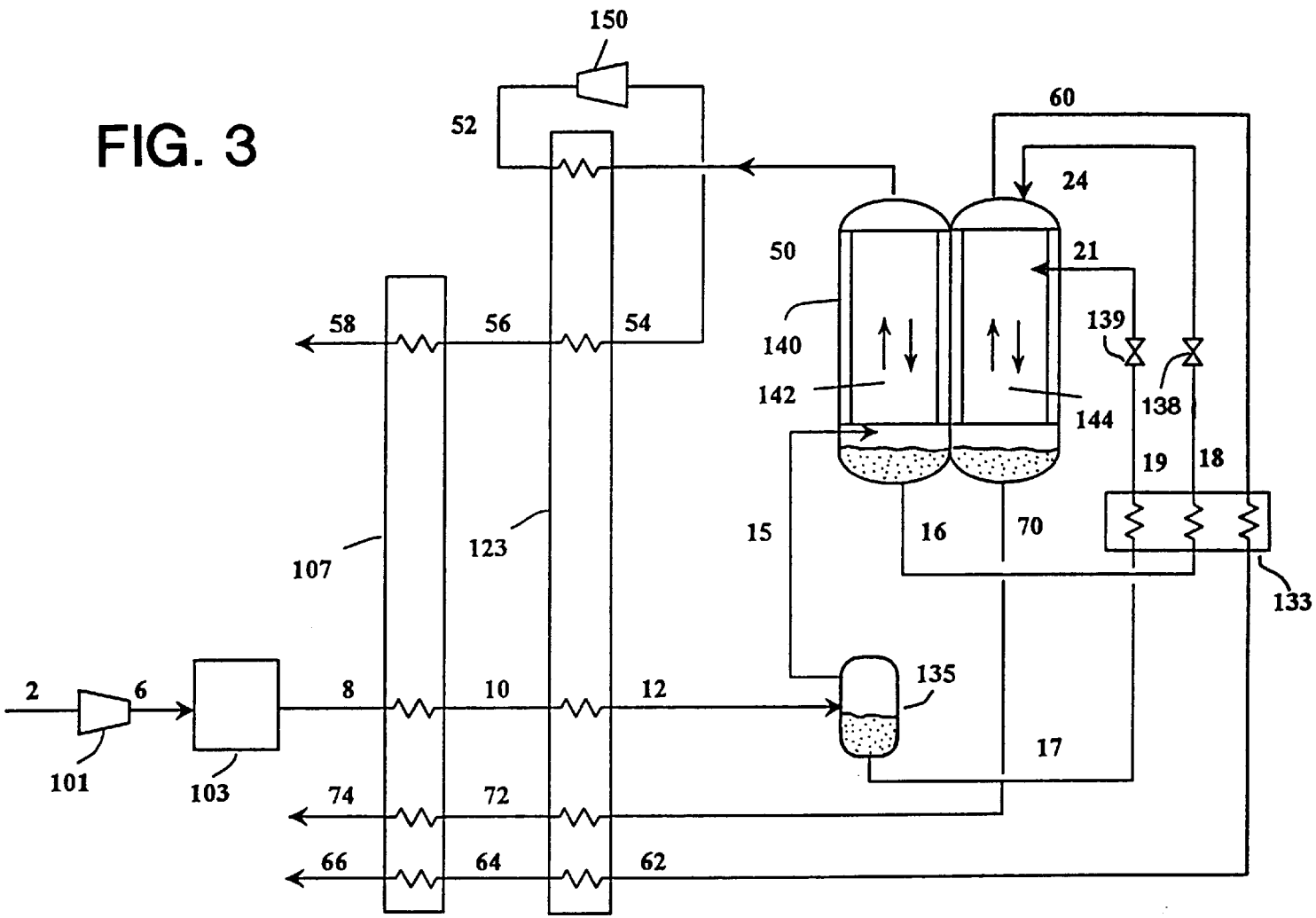
FIG. 3 is a schematic representation of a preferred embodiment of the invention wherein a phase separator is employed in conjunction with a reflux condenser.

FIG. 3 illustrates another embodiment of the invention wherein a phase separator is employed and a column is not employed. The aspects of the embodiment of the invention illustrated in FIG. 3 which are the same as those of the embodiment illustrated in FIG. 1 are commonly numbered and will not again be discussed in detail.

Referring now to FIG. 3, partially condensed feed air steam 12 is passed into phase separator 135 wherein it is separated into a vapor feed air portion and a liquid feed air portion. The vapor feed air portion is passed in stream 15 from phase separator 135 to rectifying section 142 wherein it is processed in the same manner as is the nitrogen-enriched vapor discussed in connection with the embodiment illustrated in FIG. 1. The liquid feed air portion 17 is passed from phase separator 135 to subcooler 133 wherein it is subcooled and from which it emerges as subcooled liquid stream 19. Residual liquid 16 is passed from rectifying section 142 to subcooler 133 wherein it is subcooled and from which it emerges as subcooled stream 18. Subcooled liquid streams 18 and 19 are throttled through expansion valves 138 and 139 respectively to form liquid streams 24 and 21 respectively. It is important that these two liquid streams not be mixed prior to their introduction into stripping section 144 because they have different compositions and such mixture would create a thermodynamic inefficiency. Since the liquid in stream 24 has a lower oxygen concentration than the liquid in stream 21, stream 24 is passed into stripping section 144 separately from stream 21 and at a higher level of stripping section 144 than where stream 21 is passed into stripping section 144. The liquid passed into and down the stripping section is partially vaporized as was previously described to produce oxygen-richer fluid and residual vapor which are further handled as was previously described in conjunction with FIG. 1.

Figure 4:
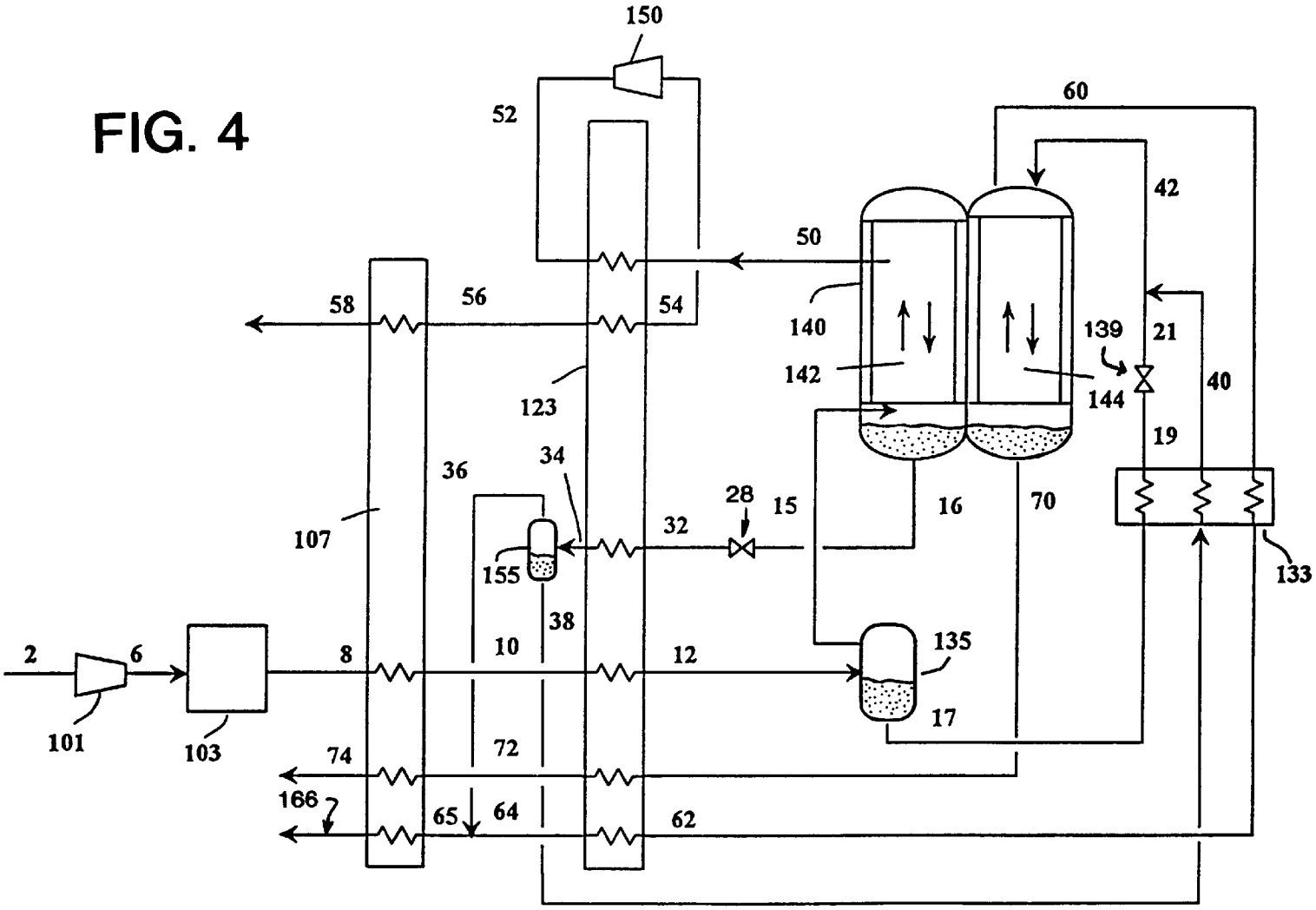
FIG. 4 is a schematic representation of another preferred embodiment of the invention wherein a phase separator is employed in conjunction with a reflux condenser.

FIG. 4 illustrates a variation of the phase separator embodiment illustrated in FIG. 3 and the features of the embodiment of the invention illustrated in FIG. 4 which are common with those of FIG. 3 will not be described again in detail.

Referring now to FIG. 4, residual liquid 16 is passed through valve 28 and as stream 32 through heat exchanger 123 wherein it is partially vaporized. Resulting two phase stream 34 comprising vapor and remaining residual liquid is passed into phase separator 155. Vapor is withdrawn from phase separator 155 in stream 36 and passed into stream 64 to form stream 65 which is warmed by passage through heat exchanger 107 and removed from the system in stream 166. Remaining residual liquid is passed from phase separator 155 in stream 38 to subcooler 133 wherein it is subcooled and from which it emerges as subcooled liquid stream 40. Because the liquid in stream 40 has about the same composition as the liquid in stream 21 these two streams can be combined without encountering a thermodynamic inefficiency. Streams 21 and 40 are combined to form liquid stream 42 which is passed into stripping section 144 wherein it is processed to produce oxygen-richer fluid and residual vapor as previously described. The oxygen-richer fluid and residual vapor are further handled in a manner similar to their handling in the embodiment illustrated in FIG. 3.

Although the invention has been described in detail with reference to certain preferred embodiments, those skilled in the art will recognize that there are other embodiments of the invention within the spirit and the scope of the claims. For example, while each of the illustrated embodiments employed rectifying sections and stripping sections having the same length, this need not always be the case. In one such embodiment the top portion of the rectifying passages could be blocked off making the stripping section longer than the rectifying section with the portion of the stripping section adjacent the blocked off portion becoming an adiabatic portion.

What is claimed is:

1. A method for producing moderate purity oxygen and moderate purity nitrogen by cryogenic air separation comprising:

(A) partially condensing feed air, passing the partially condensed feed air into a column, and separating the feed air by cryogenic rectification within the column into nitrogen-enriched vapor and oxygen-enriched liquid;

(B) passing nitrogen-enriched vapor into the rectifying section of a reflux condenser having a rectifying section and a stripping section, and passing the nitrogen-enriched vapor up the rectifying section while partially condensing the upflowing nitrogen-enriched vapor to produce nitrogen-richer fluid and residual liquid;

(C) recovering nitrogen-richer fluid as product moderate purity nitrogen and passing residual liquid into the upper portion of the column;

(D) passing oxygen-enriched liquid from the lower portion of the column into and down the stripping section of the reflux condenser while partially vaporizing the downflowing oxygen-enriched liquid to produce oxygen-richer fluid and residual vapor; and (E) recovering oxygen-richer fluid as product moderate purity oxygen.

2. The method of claim 1 wherein the feed air is divided into a first portion, which is passed into the column as vapor, and a second portion which is increased in pressure, condensed, and then passed into the column.

3. Apparatus for producing moderate purity oxygen and moderate purity nitrogen by cryogenic air separation comprising:

(A) a heat exchanger, a column, means for providing feed air to the heat exchanger, and means for providing feed air from the heat exchanger into the column;

(B) a reflux condenser having a rectifying section and a stripping section, and means for passing fluid from the upper portion of the column into the rectifying section;

(C) means for recovering fluid from the rectifying section as product moderate purity nitrogen, and means for passing fluid from the rectifying section into the upper portion of the column;

(D) means for passing fluid from the lower portion of the column into the stripping section; and (E) means for recovering fluid from the stripping section as product moderate purity oxygen.

4. The apparatus of claim 3 wherein the means for recovering fluid from the stripping section as product moderate purity oxygen includes a liquid pump.

5. A method for producing moderate purity oxygen and moderate purity nitrogen by cryogenic air separation comprising:

(A) partially condensing feed air to produce a vapor feed air portion and a liquid feed air portion, passing the vapor feed air portion into the rectifying section of a reflux condenser having a rectifying section and a stripping section, and passing the liquid feed air portion into the stripping section of the reflux condenser;

(B) passing the vapor feed air portion up the rectifying section while partially condensing the upflowing vapor feed air portion to produce nitrogen-richer fluid and residual liquid;

(C) recovering nitrogen-richer fluid as product moderate purity nitrogen and passing residual liquid into the stripping section;

(D) passing liquid feed air portion and residual liquid down the stripping section while partially vaporizing the downflowing liquid to produce oxygen-richer fluid and residual vapor; and (E) recovering oxygen-richer fluid as product moderate purity oxygen.

6. The method of claim 5 wherein the residual liquid is passed into the stripping section at a level which is higher than the level at which the liquid feed air portion is passed into the stripping section.

7. The method of claim 5 wherein the residual liquid is partially vaporized prior to being passed into the stripping section to produce vapor and remaining residual liquid, and the remaining residual liquid is passed into the stripping section.

8. Apparatus for producing moderate purity oxygen and moderate purity nitrogen by cryogenic air separation comprising:

(A) a heat exchanger, a phase separator, means for providing feed air to the heat exchanger, and means for providing feed air from the heat exchanger to the phase separator;

(B) a reflux condenser having a rectifying section and a stripping section, means for passing fluid from the phase separator to the rectifying section, and means for passing fluid from the phase separator to the stripping section;

(C) means for recovering fluid from the rectifying section as product moderate purity nitrogen;

(D) means for passing fluid from the rectifying section of the reflux condenser to the stripping section of the reflux condenser; and (E) means for recovering fluid from the stripping section as product moderate purity oxygen.

9. The apparatus of claim 8 wherein the means for passing fluid from the rectifying section of the reflux condenser to the stripping section of the reflux condenser communicates with the stripping section at a higher level than the level at which the means for passing fluid from the phase separator to the stripping section communicates with the stripping section.

10. The apparatus of claim 8 wherein the means for passing fluid from the rectifying section of the reflux condenser to the stripping section of the reflux condenser includes a subcooler.

* * * * *